United States Patent [19]

Daniels

[11] 4,020,602

[45] May 3, 1977

[54] STALL SHOWER PANEL KIT

[75] Inventor: Phillip D. Daniels, West Bloomfield, Mich.

[73] Assignee: Novi Plastics Company, Novi, Mich.

[22] Filed: Apr. 5, 1976

[21] Appl. No.: 673,739

[52] U.S. Cl. ..... 52/35; 52/288

[51] Int. Cl.[2] ..... A47K 3/16

[58] Field of Search ..... 52/34, 35, 284, 288; 4/145, 146

[56] References Cited

UNITED STATES PATENTS

| | | | |
|---|---|---|---|
| 2,282,362 | 5/1942 | Johnson | 4/146 X |
| 3,277,617 | 10/1966 | McBride | 52/35 |
| 3,977,136 | 8/1976 | Daniels | 52/35 |

*Primary Examiner*—Price C. Faw, Jr.
*Assistant Examiner*—Carl D. Friedman
*Attorney, Agent, or Firm*—Cullen, Settle, Sloman & Cantor

[57] ABSTRACT

A stall shower with back, end and front walls has its walls covered with three panels and a corner panel. Each panel overlies and is secured to the back wall and end walls. Each panel is uniform and has a right angular end flange terminating in an outturned sealing lip. The flanges of the end wall panels bear against, overly and are secured to the front walls. The flange of the back wall panel overlies and is secured to the free edge of one end wall panel. The corner panel includes a pair of right angular side plates terminating in outturned sealing lips. Said plates and lips bear against, overlap and are secured to the end of the other end wall panel and the back wall panel. Securing of the panels and flanges includes an adhesive.

5 Claims, 7 Drawing Figures

STALL SHOWER PANEL KIT

BACKGROUND OF THE INVENTION

Heretofore within stall showers having a back wall, end walls and a pair of spaced apart front walls, there has existed the need for applying a protective or ornamental covering thereto to improve the attractiveness of the stall shower or other area to improve cleaning ability and its general overall function. Conventional stall showers may be tiled or may be enamel over metal or of other masonry construction and wherein, there is at present a need for providing an inexpensive method and means for paneling such stall shower.

BRIEF DESCRIPTION OF THE INVENTION

It is an object of the present invention to provide a panel kit for a stall shower which includes a plurality of panels which can be superimposed over and adhesively mounted on and secured to the respective end, back and front walls of a stall shower enclosure.

It is another object of the present invention to provide a plurality of uniform plastic wall panels with one respectively of the panels adapted for superimposition over mounting on and securing to one of the end or rear walls of the stall shower, and wherein each of said panels has a right angular flange at one end and wherein, the flanges of the end wall panels are adapted to overlie and be secured to the front walls of the enclosure and the flange of the back wall panel adapted to overlie and be secured to one of the end wal panels.

It is another object to include within the kit a corner panel assembly including a pair of right angular wall elements adapted for projection into one rear corner of the stall shower or other enclosure so as to overlap and be secured to and sealed against the corresponding free ends of the other end wall panel and back wall panel.

It is another object to provide a convenient kit of said panels within a carton which is easily portable due to the uniformity of size of the panels and which will include the three panels and the corner panel.

These and other objects will be seen from the following specification and Claims in conjunction with the appended drawings.

THE DRAWINGS

It will be understood that the above drawings illustrate merely a preferred embodiment of the invention, and that other embodiments are contemplated within the scope of the Claims hereafter set forth.

DETAILED DESCRIPTION OF THE INVENTION

Figure 3:
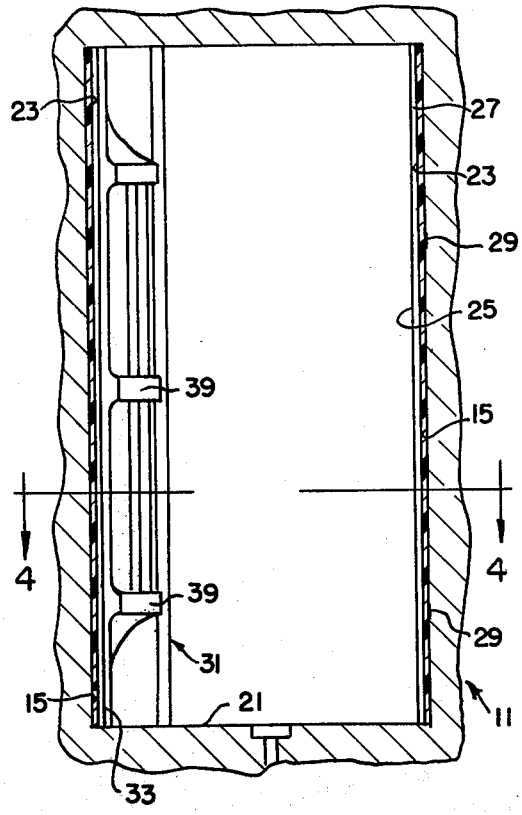
FIG. 3 is a vertical section of a stall shower enclosure with the panels applied thereto.
Figure 6:
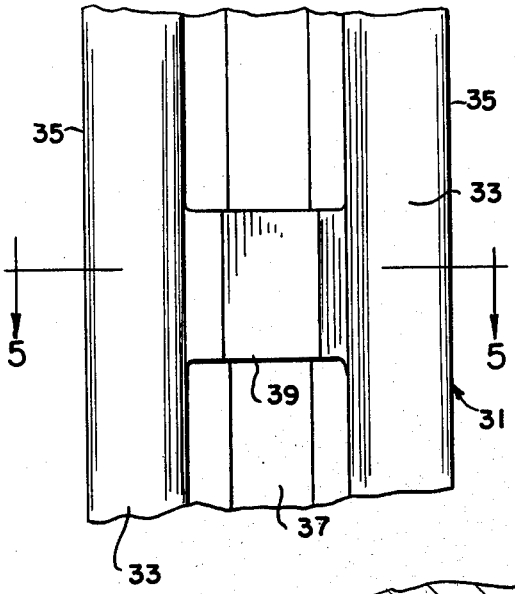
FIG. 6 is a fragmentary front elevational view of the upper portion of said corner panel.
Figure 4:
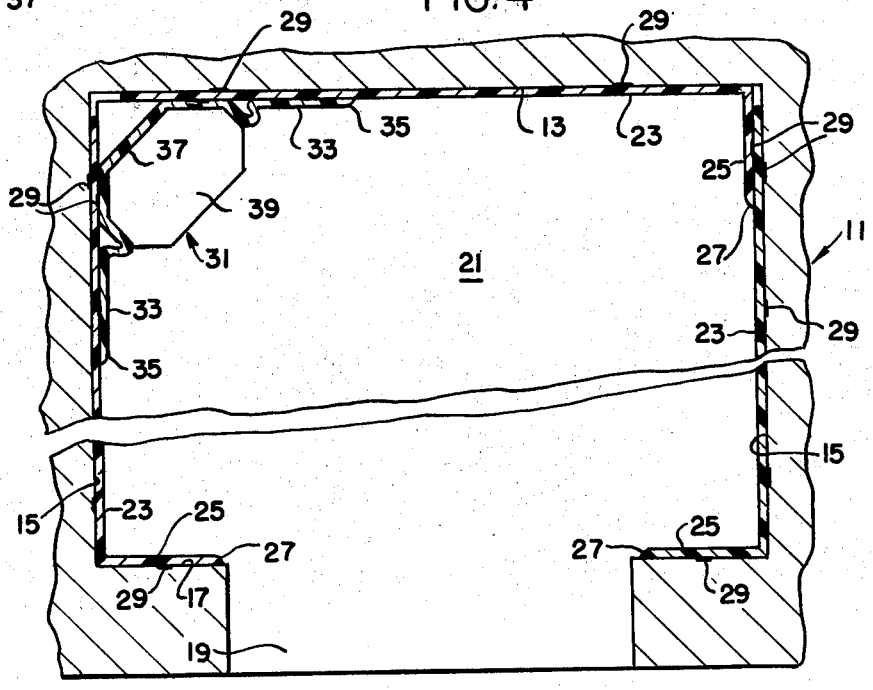
FIG. 4 is a fragmentary broken away plan section thereof corresponding to the assembly shown in FIG. 2 and taken in the direction of arrows 4—4 of FIG. 3.

Referring to the drawings, there is fragmentarily shown in FIGS. 3 and 4 the conventional stall shower 11 or other enclosure which includes back wall 13, end walls 15 and a pair of aligned inwardly directed spaced apart front walls 17. These front walls define a conventional entrance 19, FIG. 4, of a stall shower or other enclosure with a conventional floor 21 having a suitable drain.

It is for a structure of this type particularly directed to stall showers wherein, the present invention is applicable.

Figure 7:
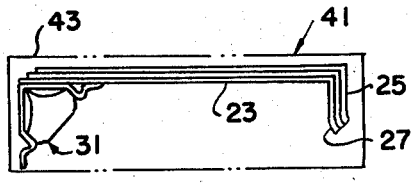
FIG. 7 is a plan view of the panel kit with the carton therefor shown in dash lines.

As shown in FIG. 7, the invention includes the kit 41 which can be stored in a carton 43, such as shown, and which includes three uniform panels 23 which are essentially flat and rectangular and have along their one sides the right angularly related corner flange 25. Each of the corner flanges terminates in the outturned lip 27 adapted for registry with a wall of the stall shower or an underlying panel portion. Each of the panels, as hereafter explained in detail, is applied to the respective walls of the shower or other enclosure, having first applied to their rear surfce strips of a suitable adhesive as at 29.

Figure 5:
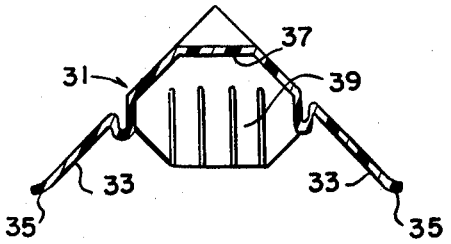
FIG. 5 is a plan view of a corner panel shown in FIG. 4.

The kit, as shown in FIG. 7, includes a corner panel 31, which includes a pair of right angular side plates 33, each terminating in the upright outturned lip 35, as best shown in FIGS. 4 and 5.

As a convenience, there is also molded into the corner panel, intermediates its height, the soap dish 39.

In the illustrative embodiment, the present panels are molded and are of a unit construction. Each of th panels in a laminate of some tripolymer such as (ABS) acrilon-nytrile-butadiene-styrene as a substrate of plastic material, having a thickness in the range of 0.057 to 0.060inches. Applied to said substrate is a laminate of an acrylic patterned material which has a printed design on its obverse side of any suitable design or mariblization. The laminate has a thickness of approximately 0.003 inches. The present plastic material for the said panels is supplied by Borg Warner Corporation as well as Dow Chemical and others.

The three panels 23–25 are of the same width. These can vary in the range of 28, 32 or 40 inches. All will have a height of 72 inches and the corner flanges of the respective panels are approximately 3 inches in width, for illustation.

Figure 1:
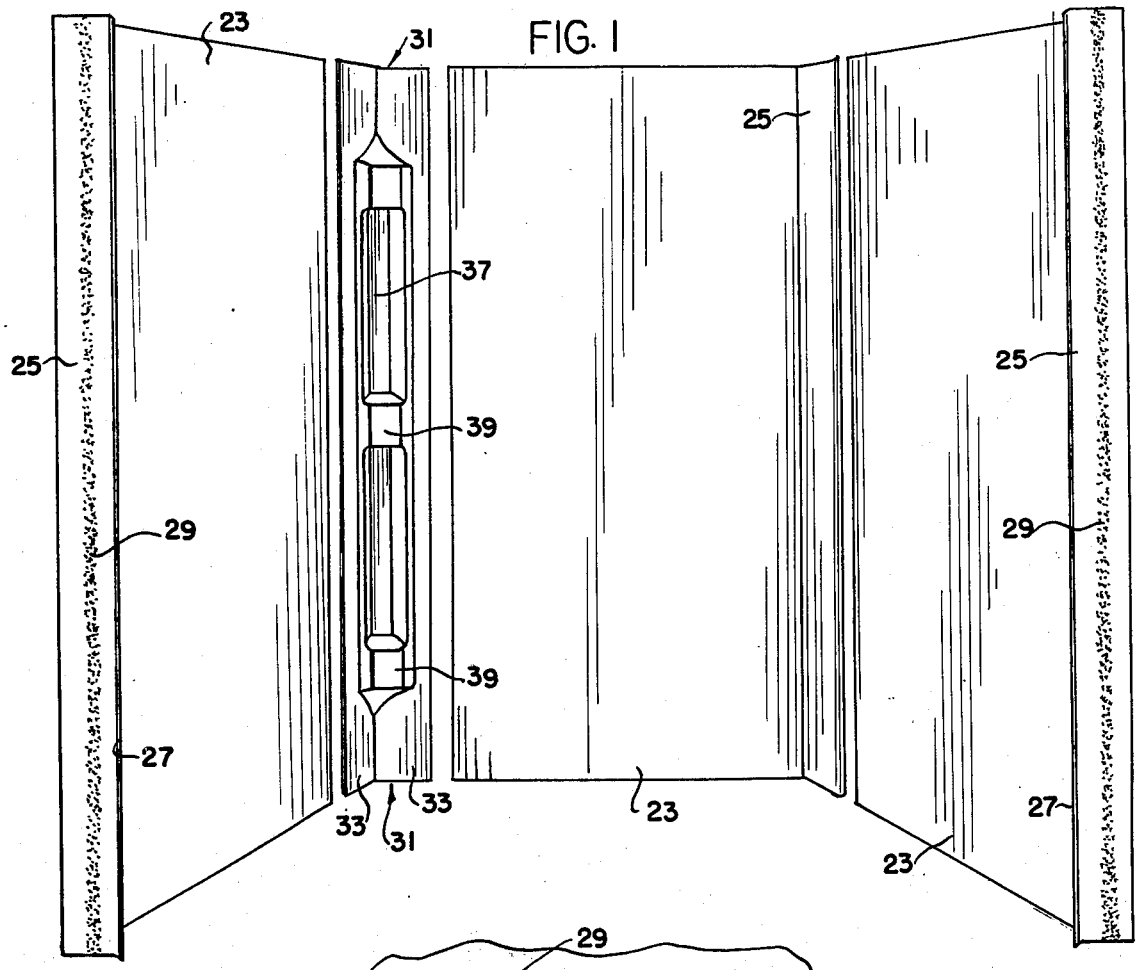
FIG. 1 is a partially broken away perspective exploded view of the respective panels as they would be used for an enclosure, such as a stall shower enclosure.
Figure 2:
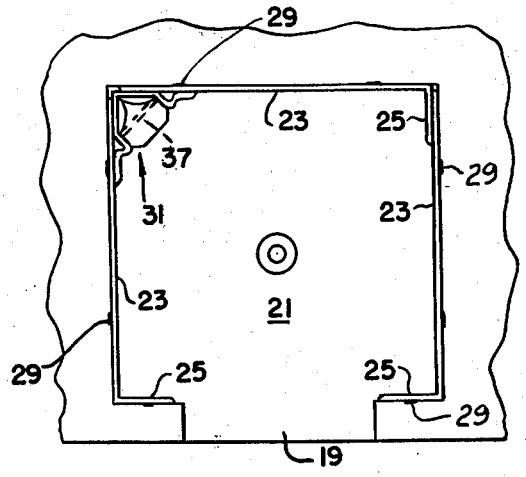
FIG. 2 is a plan section of said panels as assembled within a stall shower enclosure.

For a particular kit and for a particular enclosure such as a stall shower shown, if the panels are too wide for a particular job, the free edges thereof may be handcut for proper fitting. Accuracy in cutting is not required in view of the overlapped arrangement of the free edges as particularly shown in FIGS. 2 and 4.

As a first step, the respective pair of end panels 23 and flanges 25 have applied to their rear surfaces suitable strips of adhesive as at 29, such as an adhesive mastic material. The respective end wall panels 23 are carefully assembled with respect to the corresponding end walls 15 of the enclosre and pressed into position so as to register with said walls, starting from the floor surface 21. As assembled, the respective corner flanges 25 will be superimposed over and register with substantially the interior wall surface of the front walls 17. It is noted that the respective lips 27 are short of the opening 19, FIG. 4. With sufficient strips of adhesive applied to the rear surfaces as at 29, as shown in FIG. 4, along the height of the respective panels and flanges, the said end wall panels may be pressed into place. Whether the free edges of the flat panels are completely accurate or square does not matter in view of the fact that the corresponding free edges of the end panels are covered in the assembly shown.

As a secondary step, the back wall panel 23 and its flange 25 has applied to the rear surfaces thereof a suitable adhesive material in strips as shown at 29, FIG. 4. The back panel is carefully applied to the back wall 13 of the enclosure in such a manner that the corner flange 25 thereof and the adjacent corner nest within the corresponding corner defined between the back wall and one end wall of the enclosure. By applying manual pressure over the surface of the back wall panel 23 and its flange 25, said panel substantially overlies and covers the back wall 13 for the height of said panel and at the same time, the flange 25 overlies and is sealed against and secured to the corresponding undersurface portion of the free flat side of the end wall panel 23, as shown in FIG. 4.

As a final step, the remaining corner panel 31 of kit 41, FIG. 7, has applied to the rear surfaces of the right angular plates 33 thereof strips of adhesive 29 afterwhich said panel is pressed into the corresponding rear corner of the enclosure corresponding to back wall 13 and one of the end walls 15. Thus, the corner panel overlaps, overlies and is secured and sealed with respect to the free upright edges of the corresponding end wall and back wall panels 23, FIG. 4.

In all cases, the corresponding lip 35 for the corner panel 31 as well as the lips 27 for the flanges 25 are adapted to sealingly engage corresponding portions of the respective panels or the underlying wall such as the front walls 17. Thus, the respective outturned lips 27 engage the adjacent undersurfaces with a line-sealing contact.

For a complete seal, the exterior contact edges of the panels as at the lips may have applied thereto a line of silicone caulking, if desired.

The present end wall and back wall panels 23 are of substantially the same width, as for example, 28 inches, 32 inches or 40 inches. The respective flanges are 3 inches in width so as to substantially overlie front wall 17, FIG. 4. With the panels assembled as a kit, FIG. 7, a carton 43 may be employed which will be either 28, 32 or 40 inches wide approximately, 74 inches long and 5 inches deep.

The advantage of making the panels uniform in width is that when diassembled, they nest together as in FIG. 7 to occupy minimum storage space along with the corner panel 31. The kit is designated at 41, FIG. 7, to include a conventional corrugated or other cardboard container 43.

The most important advantage is that this container in only 30 to 40 inches wide, 74 inches high and 5 inches deep. This is easy to store, easy to ship, easy to carry and transport in an automobile.

Another important advantage of the present uniform width of the panel is that a single tool or mold is needed for all three uniform panels. Production manufacturing costs are reduced since all three panels are assembled flat and nest together in the kit, FIG. 7. The use of the comparatively small package 30 to 40 inches wide, 74 inches high and 5 inches wide is an important merchandising factor due to the ease of storing, handling and shipping; more units to the truckload and railcar.

With respect to the adhesive 29 above, one such adhesive is referred to as a construction adhesive sold by Franklin Chemical Industries of Columbus, Ohio. It includes synthetic elastomeric polymer and resins. Any suitable pressure-sensitive adhesive could be employed or a suitable water-proof caulking having adhesive characteristics. That is, a construction adhesive which exceeds the specifications of American Plywood Association and FHA-HUD use of materials bulletin No. 60.

Having described my invention, reference should now be had to the following Claims.

I claim:

1. In a stall shower having a back wall, end walls and a pair of aligned inwardly directed spaced apart front walls; a plurality of flat, rectangular panels respectively mounted over said back and end walls, each panel having an upright right angular end flange terminating in an elongated outturned lip;

a pair of said panels bearing against and superimposed over and secured to said end walls, with their corresponding flange bearing against and substantially covering and secured to the corresponding front walls;

the third panel bearing against and overlying said back wall, with its flange overlying, bearing against and secured to the free end of one of said end wall panels; and an upright corner panel including a pair of right angular side plates terminating in elongated outturned lips, said corner panel projected into a back and end wall corner overlying the free ends of the other end wall panel and back wall panel and secured thereto, said lips sealingly bearing against the underlying wall or panel surface.

2. In the stall shower of claim 1, the securing of said panels and flanges including strips of adhesive material over and along the rear surfaces of said panel and flanges.

3. In a stall shower having a back, end and front walls, and a thin plastic panel overlying and secured respectively to said back and end walls, said panels being of the same width, each having an upright right angular end flange terminating in an outturned lip; the flanges of the end wall panels bearing against, overlying and secured to said front walls; the flange of said back wall panel overlying and secured to the free edge portion of one end wall panel; and a corner panel including a pair of right angular side plates terminating in an outturned lip, said corner panel projected into a back and end wall corner overlying the free ends of the other end wall panel and back wall panel and secured thereto, said lips sealingly bearing against the underlying wall or panel surface.

4. In a stall shower having a back wall, end walls and a pair of aligned inwardly directed spaced apart front walls, a plurality of flat, rectangular panels all of the same width respectively mounted over said back and end walls, each panel having an upright right angular end flange;

a pair of said panels bearing against and superimposed over and secured to said end walls, with their corresponding flange bearing against and substantially covering and secured to the corresponding front walls;

the third panel bearing against and overlying said back wall, with its flange overlying, bearing against and secured to the free end of one of said end wall panels; and an upright corner panel including a pair of right angular side plates, said corner panel projected into a back and end wall corner overlying the free ends of the other end wall panel and back wall panel and secured thereto.

5. A panel kit for a stall shower enclosure having a back wall, end walls and a pair of aligned spaced apart front walls, comprising:

three symmetrical rectangular panels, all of the same width, each panel having an upright right angular end flange of the same width, and terminating in an outturned sealing lip;

a pair of said panels adapted to bear against, cover and be secured to said end walls, with their corresponding flanges bearing against and substantially covering and secured to the corresponding front walls;

the third panel adapted to bear against, overly and be secured to said back wall with its flange overlying, bearing against and secured over the free end of one said end wall panels;

and an upright corner panel including a pair of right angular side plates terminating in outturned lips, adapted to be projected into a back end wall corner to overly the free ends of the other end wall panel and back wall panel for securing thereto;

said three panels and their front flanges being nested together and with the corner panel for storage within a compact container of minimum width of the panels.

* * * * *